US007358967B2

(12) United States Patent
Kim et al.

(10) Patent No.: US 7,358,967 B2
(45) Date of Patent: Apr. 15, 2008

(54) PLASMA DISPLAY PANEL AND METHOD OF DRIVING THE SAME

(75) Inventors: Tae-Seong Kim, Asan-si (KR); Woo-Joon Chung, Asan-si (KR); Jin-Sung Kim, Cheonan-si (KR); Kyoung-Ho Kang, Suwon-si (KR); Seung-Hun Chae, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 731 days.

(21) Appl. No.: 10/962,717

(22) Filed: Oct. 13, 2004

(65) Prior Publication Data

US 2005/0110704 A1 May 26, 2005

(30) Foreign Application Priority Data

Oct. 15, 2003 (KR) ..... 10-2003-0071891
Oct. 21, 2003 (KR) ..... 10-2003-0073508

(51) Int. Cl.
*G09G 3/13* (2006.01)

(52) U.S. Cl. ..... 345/204; 345/37; 345/41; 345/60; 345/205; 313/582; 313/583

(58) Field of Classification Search ..... 345/37, 345/41, 60, 204, 205; 313/582, 583
See application file for complete search history.

(56) References Cited

U.S. PATENT DOCUMENTS

| | | | | |
|---|---|---|---|---|
| 5,745,086 | A | 4/1998 | Weber | 345/63 |
| 7,250,724 | B2 * | 7/2007 | Kim | 313/583 |
| 2003/0169216 | A1 * | 9/2003 | Chung et al. | 345/60 |
| 2003/0184502 | A1 | 10/2003 | Makino | |
| 2003/0222835 | A1 * | 12/2003 | Yoon et al. | 345/60 |
| 2004/0051456 | A1 * | 3/2004 | Kim | 313/582 |

FOREIGN PATENT DOCUMENTS

| | | |
|---|---|---|
| JP | 2002-215090 | 7/2002 |
| JP | 2003-122299 | 4/2003 |

* cited by examiner

*Primary Examiner*—Bipin Shalwala
*Assistant Examiner*—Vincent E. Kovalick
(74) *Attorney, Agent, or Firm*—H.C. Park & Associates, PLC

(57) ABSTRACT

A method for driving a plasma display panel, including a reset period, an address period, and a sustain discharge period, wherein the reset period has a rising ramp section. During the rising ramp section of the reset period, a flat period of maintaining a peak voltage of a rising ramp applied to a scan electrode is maintained for longer than a period until a variation in a state of wall charges of the scan electrode is ended in all discharge cells.

16 Claims, 7 Drawing Sheets

PLASMA DISPLAY PANEL AND METHOD OF DRIVING THE SAME

This application claims the benefit and priority of Korean Patent Application Nos. 2003-71891, filed on Oct. 15, 2003, and 2003-73508, filed on Oct. 21, 2003, which are hereby incorporated by reference for all purposes as if fully set forth herein.

BACKGROUND OF THE INVENTION

1. Field of the Invention

The present invention relates to a plasma display panel and a method of driving the same. More specifically, the present invention relates to a plasma display panel having improved wall charge states due to driving waveforms of a reset period.

2. Discussion of the Related Art

Among flat panel displays, plasma display panels (PDPs) are being actively pursued due to their luminance, high luminous efficiency, and wide viewing angle.

The PDP displays text or images using plasma generated by a gas discharge, and it has hundreds of thousands to millions of pixels arranged in a matrix configuration.

A conventional PDP will now be described with reference to FIG. 1 and FIG. 2.

FIG. 1 is a partial perspective view of a conventional PDP.

Referring to FIG. 1, a plurality of pairs of electrodes, which include a scan electrode 4 and a sustain electrode 5, are arranged in parallel on a first substrate 1. The scan and sustain electrodes 4 and 5 are covered with a dielectric layer 2 and a protective layer 3. A plurality of address electrodes 8, covered with an insulating layer 7, is arranged on a second substrate 6. Barrier ribs 9 are formed on the insulating layer 7 in parallel with, and in between, the address electrodes 8. Phosphor layers 10 are formed on a surface of the insulating layer 7 and each side of the barrier ribs 9. The first substrate 1 and the second substrate 6 are sealed together with a discharge space 11 therebetween, so that the scan electrode 4 and the sustain electrode 5 pairs are perpendicular to the address electrodes 8. Portions of the discharge space 11 at intersections between the address electrodes 8 and the scan electrode 4 and the sustain electrode 5 pairs form discharge cells 12.

FIG. 2 is shows a typical electrode arrangement of the conventional PDP of FIG. 1.

Referring to FIG. 2, the PDP electrodes are arranged in an n×m matrix. The address electrodes $A_1$ to $A_m$ are arranged in a column direction, and the scan electrodes $Y_1$ to $Y_n$ and the sustain electrodes $X_1$ to $X_n$ are arranged in a zigzag configuration in a row direction. A discharge cell 12 of FIG. 2 corresponds to the discharge cell 12 of FIG. 1.

Referring to FIG. 3, a method of driving the conventional PDP will now be described. A gray scale is displayed by dividing a field into a plurality of subfields. In terms of a time period, one subfield includes a reset period PR, an address period PA, and a sustain period PS.

The reset period PR erases wall charges generated by a sustain discharge of a previous subfield and initializes a state of each discharge cell for a next addressing operation.

The address period PA selects addressed cells and accumulates wall charges in the addressed cells.

The sustain period PS performs a sustain discharge for displaying an image on the selected discharge cell. During the sustain period PS, sustain discharges are performed by alternately applying a sustain pulse to the sustain electrode X and the scan electrode Y.

Specifically, after the reset period PR, the wall charges should be in an optimum state so that stable addressing may take place in the following address period PA. This is particularly important when performing address discharges at a low voltage.

The reset period PR includes an erase section PR1, a rising ramp section PR2, and a falling ramp section PR3.

The erase section PR1 erases the charges generated during the sustain period PS of the previous subfield by the sustain discharge. The rising ramp section PR2 generates the wall charges in the scan electrodes Y, the sustain electrodes X and the address electrodes A. The falling ramp section PR3 erases some of the wall charges generated during the rising ramp period PR2 in order to more efficiently perform the address discharge.

During the rising ramp section PR2, a ramp voltage that gradually increases from a voltage $V_s$ to a voltage $V_{set}$, which is a voltage higher than a discharge start voltage, is applied to the scan electrodes Y, while a voltage of 0 V is applied to the address electrodes A and the sustain electrodes X. While this ramp voltage is rising, a slight reset discharge occurs from the scan electrodes Y to the address electrodes A and the sustain electrodes X. This reset discharge simultaneously accumulates (−) wall charges in the scan electrodes Y and (+) wall charges in the address electrodes A and the sustain electrodes X.

During the falling ramp section PR3, a ramp voltage that decreases from a voltage $V_s$ to a voltage $V_n$ is applied to the scan electrodes Y, while the sustain electrodes X are maintained at a voltage $V_e$. While this ramp voltage is decreasing, a second slight reset discharge occurs in all discharge cells, which decreases (−) wall charges in the scan electrodes Y and (+) wall charges in the sustain electrodes X and the address electrodes A.

After the rising ramp voltage is applied to the scan electrodes Y during the rising ramp section PR2, if the PDP enters the falling ramp section PR3 without sufficiently observing a flat period of maintaining a voltage of $V_s+V_{set}$ from a peak point of the ramp, the discharge required in the rising ramp section PR2 may not be performed sufficiently. Therefore, the desired state of the wall charges may not be formed sufficiently.

Also, during the falling ramp section PR3, if the PDP enters the address period PA without sufficiently observing a flat period of maintaining a voltage of Vn, the reset period PR may end before wall charges are uniformly formed within all discharge cells. Accordingly, the PDP may enter the address period PA without uniform wall charges, which may cause unreliable address discharges.

SUMMARY OF THE INVENTION

The present invention provides a PDP and a method of driving the same, in which sufficient wall charges may be formed in the discharge cells during a rising ramp section of a reset period.

The present invention also provides a PDP and a method of driving the same, in which uniform wall charges may be formed in the discharge cells during a falling ramp section of a reset period.

Additional features of the invention will be set forth in the description which follows, and in part will be apparent from the description, or may be learned by practice of the invention.

The present invention discloses a method of driving a PDP, the method including a reset period, an address period, and a sustain discharge period, and the reset period has a rising ramp section. During the rising ramp section of the reset period, a flat period of maintaining a peak voltage of a rising ramp applied to a scan electrode is maintained until a variation in a state of wall charges of the scan electrode ends in all discharge cells.

The present invention also discloses a method of driving a PDP, the method including a reset period, an address period, and a sustain discharge period, and the reset period has a rising ramp section and a falling ramp section. During the falling ramp section of the reset period, a flat period of maintaining a bottom voltage of a falling ramp applied to a scan electrode is maintained until a state of wall charges of the scan electrode is uniform in all discharge cells.

The present invention also discloses a PDP having a first electrode and a second electrode arranged in parallel on a first substrate, and a third electrode formed on a second substrate to cross the first and second electrodes. A circuit applies a driving signal to the first, second, and third electrodes, wherein the circuit gradually rises a difference between voltages applied to the first and second electrodes during a first section of a reset period from a first voltage to a second voltage, and maintains the difference between the voltages at the second voltage during a second section. The second section has a period in which a wall voltage is constant in a discharge cell.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

The present invention will now be described more fully with reference to the accompanying drawings, in which exemplary embodiments of the invention are shown.

Figure 1:
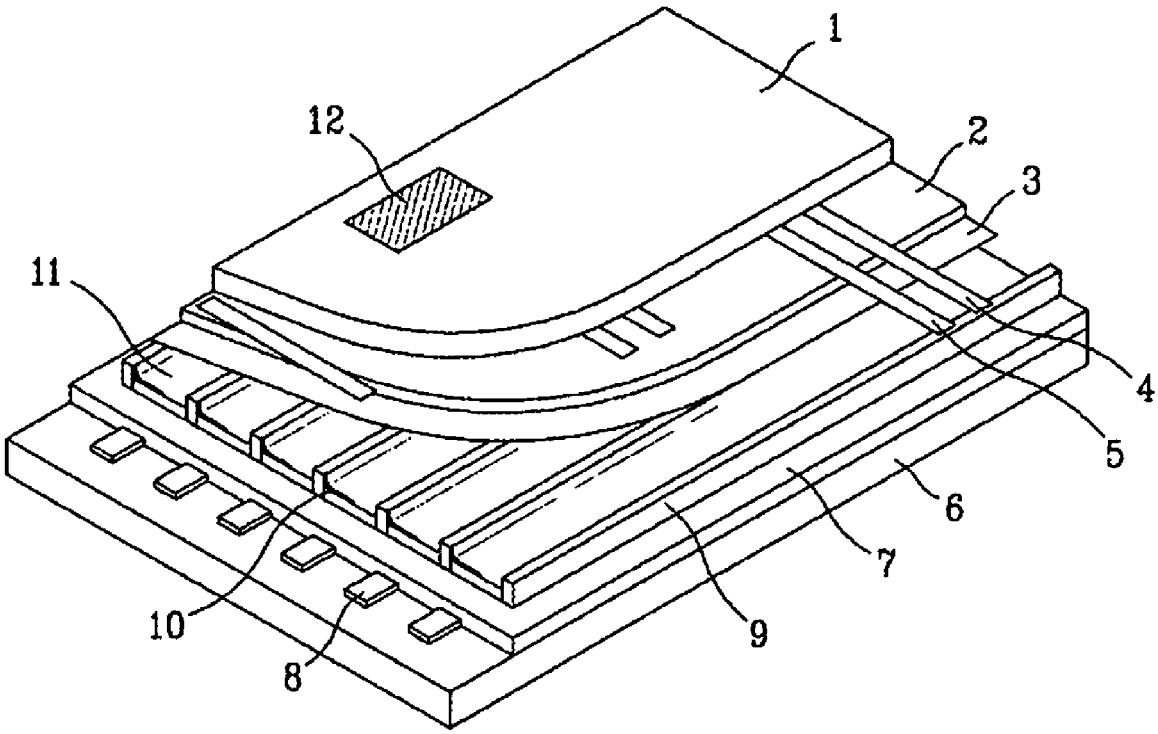
FIG. 1 (PRIOR ART)
FIG. 1 is a partial perspective view of a conventional PDP.
Figure 2:
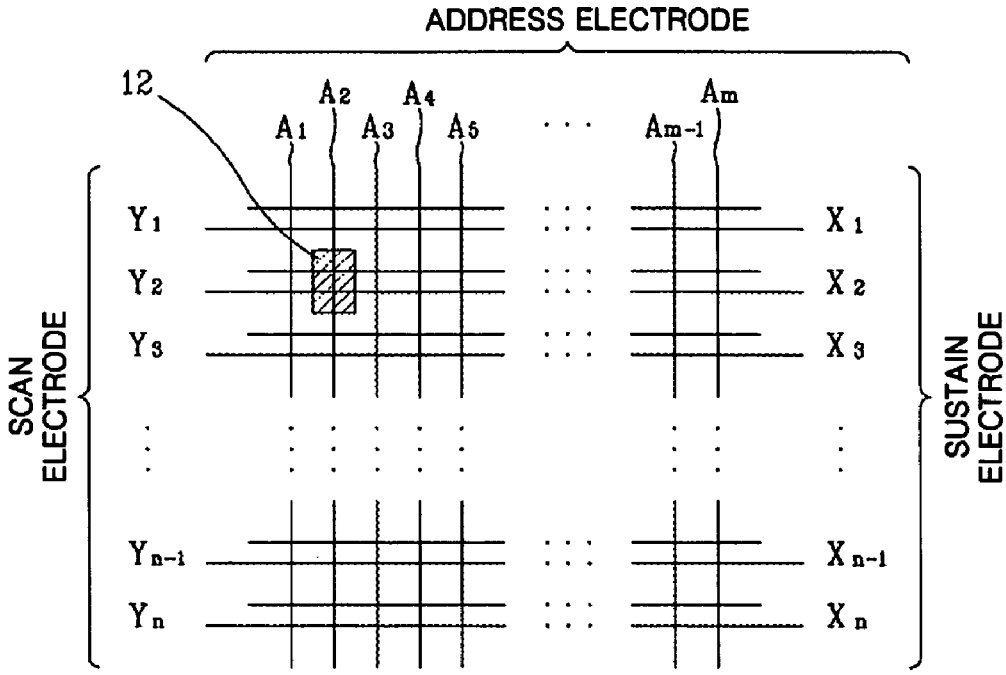
FIG. 2 (PRIOR ART)
FIG. 2 shows an electrode arrangement of a conventional PDP.
Figure 3:
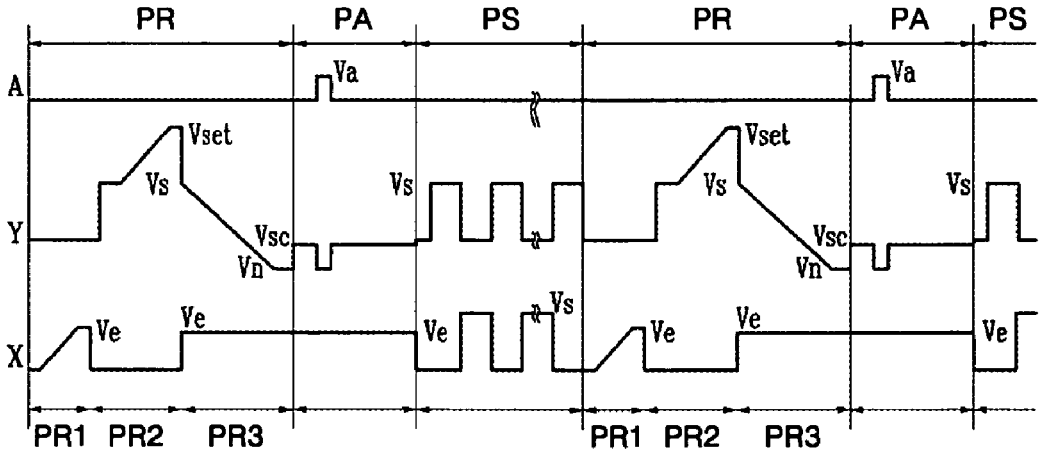
FIG. 3 (PRIOR ART)
FIG. 3 shows a driving waveform of a conventional PDP.
Figure 4:
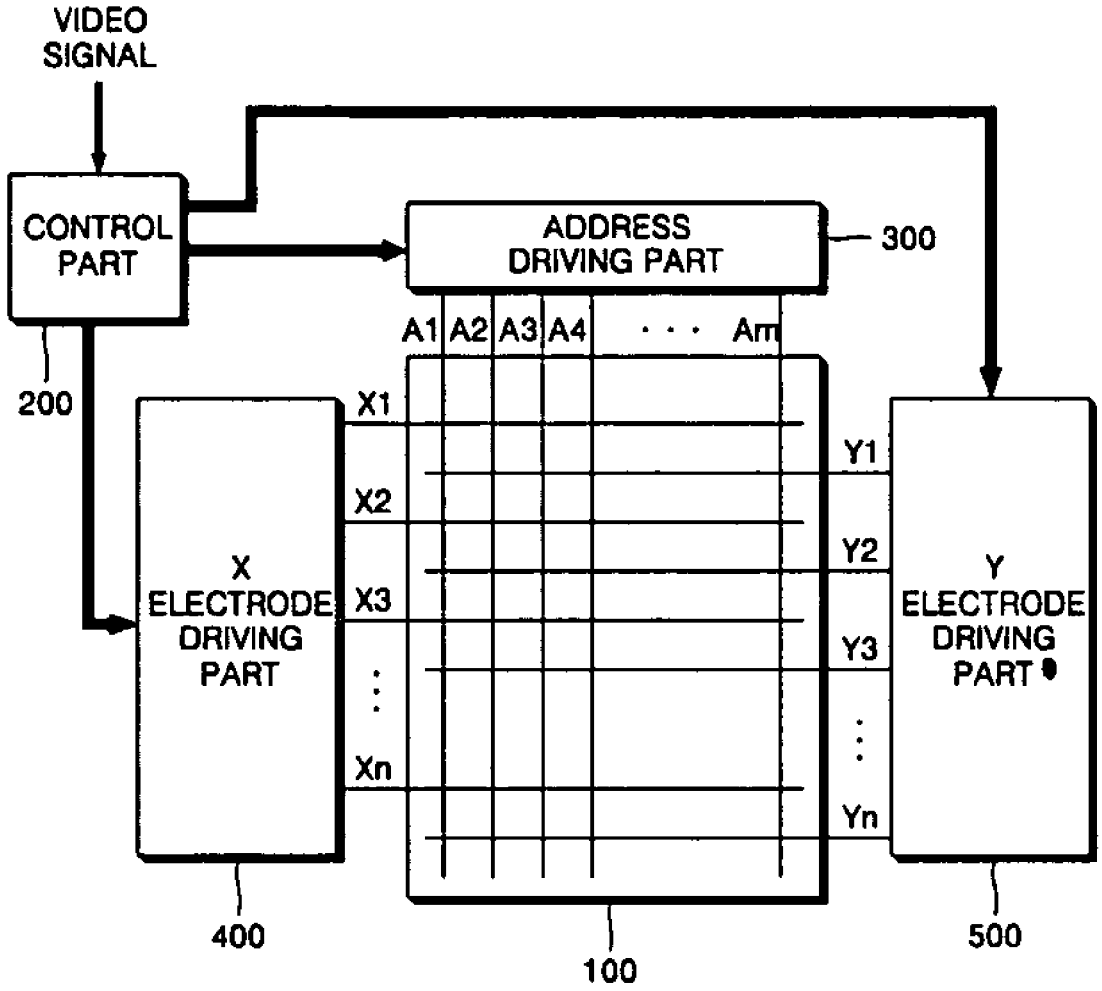
FIG. 4 is a view of a PDP according to an exemplary embodiment of the present invention.

FIG. 4 is a view of a PDP according to an exemplary embodiment of the present invention. Referring to FIG. 4, the PDP includes a plasma panel 100, a control part 200, an address driving part 300, an X electrode (sustain electrode) driving part 400, and a Y electrode (scan electrode) driving part 500.

The plasma panel 100 includes address electrodes $A_1$ to $A_m$, arranged in a column direction, and sustain electrodes $X_1$ to $X_n$ and scan electrodes $Y_1$ to $Y_n$ arranged in a zigzag configuration in a row direction.

The control part 200 receives a video signal and outputs a driving control signal for the address electrodes A, sustain electrodes X and scan electrodes Y.

The address driving part 300 receives the address driving control signal from the control part 200 and applies a display data signal to each address electrode A in order to select a discharge cell.

The X electrode driving part 400 receives the X electrode driving control signal from the control part 200 and applies a driving voltage to the X electrode.

The Y electrode driving part 500 receives the Y electrode driving control signal from the control part 200 and applies a driving voltage to the Y electrode.

According to a first exemplary embodiment, during a rising ramp section of the reset period, the Y electrode driving part 500 applies a ramp voltage to the scan electrodes Y that gradually rises from a voltage of $V_s$, which is lower than the discharge start voltage, to a voltage $V_{set}$, which is higher than the discharge start voltage, and then maintains the voltage $V_{set}$ at the scan electrodes Y until there is no variation of the wall charges.

Figure 5:
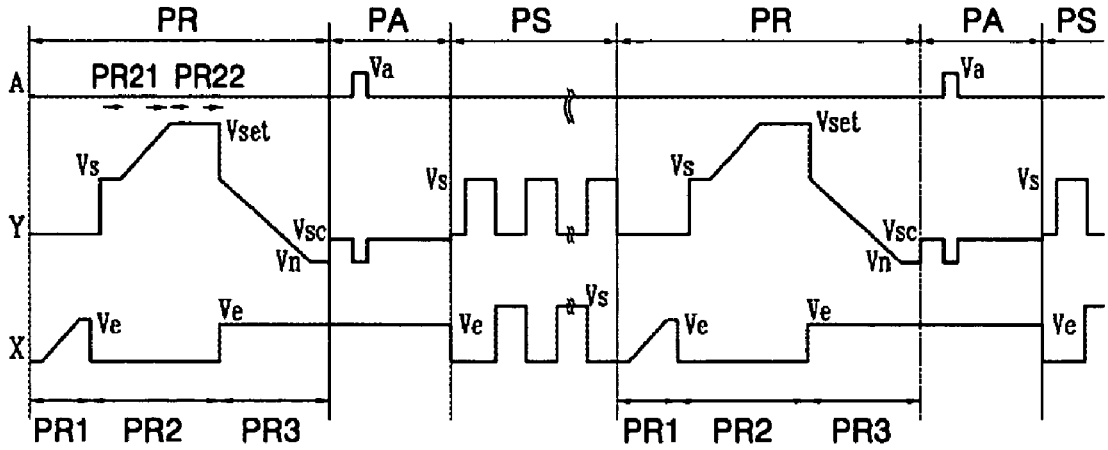
FIG. 5 shows a driving waveform of a PDP according to a first exemplary embodiment of the present invention.
Figure 6:
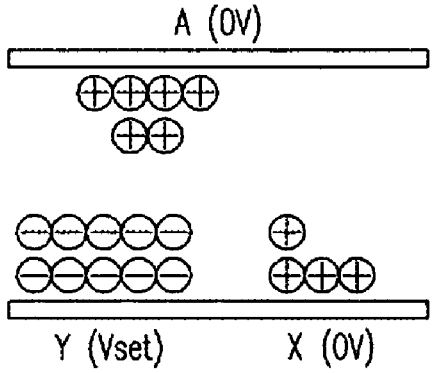
FIG. 6 shows a distribution of wall charges according to the driving waveform of FIG. 5.

FIG. 5 is a driving waveform of a PDP according to a first exemplary embodiment of the present invention, and FIG. 6 shows a distribution of the wall charges according to the driving waveform of FIG. 5.

Referring to the driving waveform of FIG. 5, a subfield includes a reset period PR, an address period PA and a sustain period PS. The reset period PR includes an erase section PR1, a rising ramp section PR2 and a falling ramp section PR3.

During the erase section PR1, wall charges generated by a previous sustain discharge are erased. During the rising ramp section PR2, wall charges are generated in the scan electrodes Y, the sustain electrodes X and the address electrodes A. Some wall charges generated during the rising ramp period PR2 may are erased during the falling ramp section PR3 in order to efficiently perform a subsequent address discharge.

The PDP includes a scan/sustain driver circuit for applying the driving voltage to the scan electrodes Y and the sustain electrodes X in the periods PR, PA and PS, and an address driver circuit for applying the driving voltage to the address electrodes A.

During the first section PR21 corresponding to an initial stage of the rising ramp section PR2, a ramp voltage that smoothly rises from a voltage of $V_s$ to a voltage of $V_{set}$ is applied to the Y electrodes, while the address electrodes A and the sustain electrodes X are maintained at a reference voltage of 0 V. While this ramp voltage rises, a slight reset discharge occurs from the scan electrodes Y to the address electrodes A and the sustain electrodes X at all discharge cells. This discharge may simultaneously accumulate negative (−) wall charges in the scan electrodes Y and positive (+) wall charges in the address electrodes A and the sustain electrodes X.

Here, wall charges are generated and accumulated on the wall (for example, the insulating layer) of the discharge cell near each electrode. Although the wall charges do not actually contact the electrodes, for simplicity, the description is written as if the wall charges are formed or accumulated on them. Also, a wall voltage means an electric potential difference that is formed on the wall of the discharge cell due to the wall charges.

Since the address electrode A tends to maintain an average electric potential between the scan electrode Y and the sustain electrode X, the state of the wall charges at an end portion of the rising ramp section PR2 is as shown in FIG. 6. In other words, the wall charges formed on the address electrode A correspond to the voltage $V_{set}$ applied to the scan electrode Y, the electric potential generated by the wall charges formed on the scan electrode Y, the voltage of 0 V applied to the sustain electrode X, and the electric potential generated by the wall charges formed on the sustain electrode X.

During the second section PR22, which corresponds to a late stage of the rising ramp section PR2, the flat period may be sufficiently observed by maintaining the final voltage $V_{set}$, applied in the first section PR21, for a predetermined time period, while the address electrode A and the sustain electrode X are maintained at the reference voltage of 0 V. During the first section PR21, a discharge may occur when the voltage difference between the X and Y electrode exceeds the discharge start voltage, so that the discharge occurs after a predetermined time period. On the contrary, during the second section PR22, the voltage of $V_{set}$ is constant for a predetermined time period, so that the wall charges may accumulate in the discharge cells corresponding to the sustain electrodes X and the scan electrodes Y. Therefore, the desired state of the wall charges may be obtained even when applying a low $V_{set}$ voltage.

During the falling ramp section PR3, a ramp voltage that falls from the voltage $V_s$ to the voltage $V_n$ is applied to the scan electrodes Y, while the voltage $V_e$ is applied to the sustain electrodes X. This falling ramp voltage may fall with a constant slope, or it may fall with a varying slope.

During the following address period PA, the scan electrodes Y may be selected by applying the voltage $V_n$ to them in sequence, while maintaining other scan electrodes Y at a voltage $V_{sc}$. The address voltage $V_a$ is applied to corresponding address electrodes A, which selects those cells in which the voltage $V_n$ is applied. The address discharge may be achieved due to the difference between the voltage $V_a$ and the voltage $V_n$ and the wall voltage due to the wall charges formed on the address electrodes A and the scan electrodes Y.

During the sustain period PS, a sustain pulse is alternately applied to the scan electrodes Y and the sustain electrodes X, thereby providing the voltage difference of $V_s$ and $-V_s$ between them. The voltage $V_s$ is lower than the discharge start voltage between the scan electrode Y and the sustain electrode X. When the address discharge generates the wall voltage between the scan electrode Y and the sustain electrode X, the discharge occurs between the scan electrode Y and the sustain electrode X due to the wall voltage and the voltage $V_s$.

The state of the wall charges according to the driving waveform of the first exemplary embodiment will now be described with reference to FIG. 7.

Figure 7:
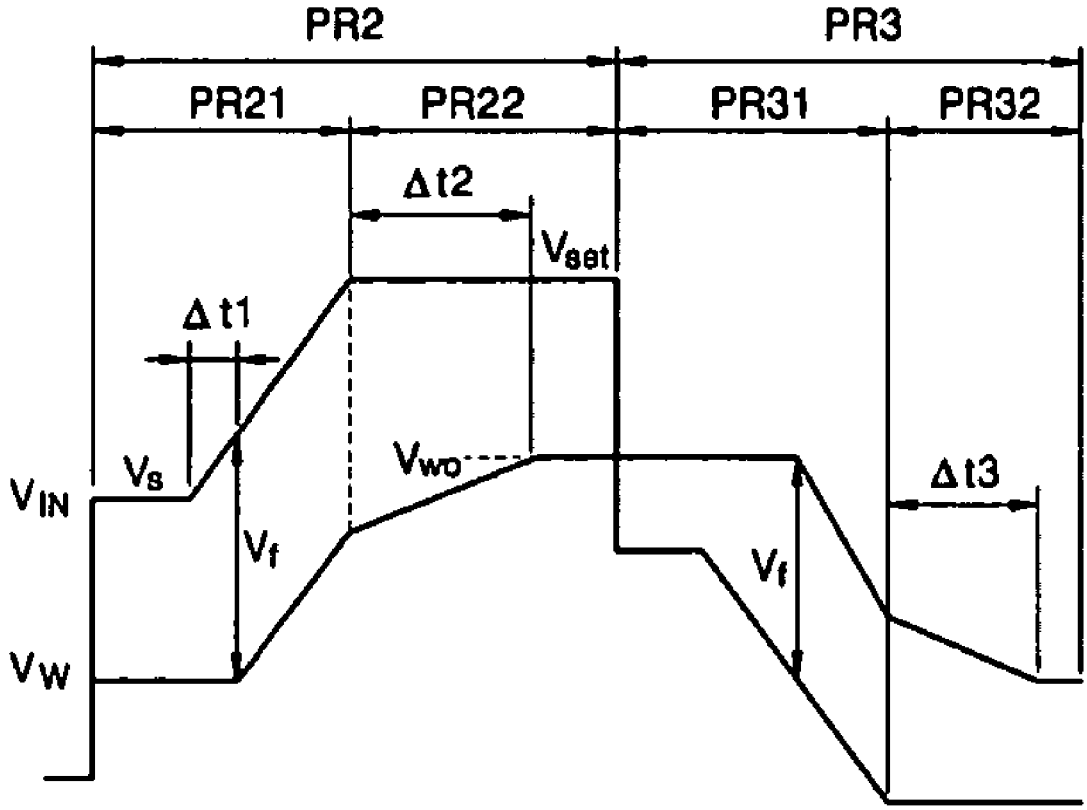
FIG. 7 shows a wall voltage and an applied voltage according to the driving waveform of FIG. 5.

FIG. 7 shows the wall voltage and the applied voltage according to the driving waveform of FIG. 5.

As shown in FIG. 7, applied voltage $V_{IN}$ represents a voltage difference between a scan electrode Y and a sustain electrode X. The applied voltage $V_{IN}$ gradually rises from the voltage $V_s$ to the voltage $V_{set}$ during the first section PR21 of the rising ramp section PR2, constantly maintains the voltage $V_{set}$ during the second section PR22, and gradually falls from a voltage $V_s$-$V_e$ to a voltage $V_n$-$V_e$ during the falling ramp section PR3. When a discharge is caused by applying the gradually rising/falling ramp voltage in this manner, the wall voltage $V_w$ inside the discharge cell may increase at the same rate as the applied voltage $V_{IN}$.

When the wall voltage $V_w$ between the scan electrode Y and the sustain electrode X is $V_{w0}$ at the end of the rising ramp section PR2 as shown in FIG. 7, a discharge occurs when the voltage difference between the voltage $V_{w0}$ and the applied voltage $V_{IN}$ reaches the discharge start voltage $V_f$. When a discharge occurs by applying the gradually rising/falling ramp voltage, the wall voltage $V_w$ inside the discharge cell may also decrease at the same rate as the applied voltage $V_{IN}$. Since this principle is disclosed in U.S. Pat. No. 5,745,086, its detailed description will be omitted.

During the rising ramp section PR2, the discharge occurs after the predetermined time difference Δt1. The discharge effects may continue by lengthening the second section PR22 because more wall charges may accumulate and the gain of the voltage $V_{set}$ may be obtained. The second section PR22 may be maintained from the end of the first section PR21 until an amount of the wall charge $V_w$ remains fixed.

In other words, more wall charges may accumulate on the sustain electrode X and the scan electrode Y by maintaining the peak flat period PR22 for longer than a predetermined duration Δt2. As FIG. 7 shows, the wall voltage $V_w$ increases due to the wall charges that continue to accumulate on the scan electrode within the predetermined duration Δt2 of the peak flat period PR22.

U.S. Pat. No. 5,745,086 discloses in detail the reset period when the rising ramp voltage and the falling ramp voltage are applied. According to the disclosure, when the rising slope of the applied voltage is very smooth, the current due to the discharge gas is maintained relatively constant, so that the voltage applied to the discharge gas during the discharge is also constant. Therefore, when the rising slope of the applied voltage $V_{IN}$ is equal to that of the wall voltage $V_w$, the wall voltage $V_w$ is constant during the peak flat period.

However, as FIG. 7 shows, the rising slope of the applied voltage $V_{IN}$ may not be equal to that of the wall voltage $V_w$, therefore, the wall voltage $V_w$ at the peak flat period PR22 continues to increase during the predetermined duration Δt2 due to the electric and structural deviation between the discharge cells. If the peak flat period PR22 is maintained is for a shorter period than the predetermined duration Δt2, the wall charges may not accumulate sufficiently before the falling ramp section PR3 begins.

According to the first exemplary embodiment of the PDP of the present invention, the peak flat period PR22 is maintained for a longer period of time than the predetermined duration Δt2, which may end the variation of the wall charges. The wall voltage $V_w$ is then maintained at $V_{w0}$, and the falling ramp section PR3 begins.

During an initial period PR31 of the falling ramp section PR3, a ramp voltage that falls from the voltage of $V_s$ to the voltage of $V_n$ is applied to the scan electrode Y, while the sustain electrode X is maintained at the voltage of $V_e$. The falling ramp voltage may be a voltage that falls with a constant slope, or a voltage that falls with a varying slope, depending on predetermined periods. During the falling of the ramp voltage, a second reset discharge may occur in all discharge cells, thereby decreasing the negative (−) wall charges of the scan electrode Y and the positive (+) wall charges of the sustain electrode X and the address electrode Y.

Referring to FIG. 7, the wall voltage $V_w$ continues to decrease for a predetermined duration Δt3, even in the bottom flat period PR32 of the falling ramp section PR3. Accordingly, if the bottom flat period PR32 of the falling ramp does not exist or is too short, the reset period PR may end while negative (−) charges around the scan electrode Y are not sufficiently uniform due to the electric and structural deviation of the discharge cell. This non-uniform state of the wall charges may cause an erroneous discharge during the subsequent addressing operation. Therefore, a second characteristic of the present invention is to form a uniform state of the wall charges in all discharge cells by observing the bottom flat period PR32 for a longer period of time than the predetermined duration Δt3.

As described above, when the bottom flat period PR32 is sufficiently secured, the wall charges may be sufficiently erased from all cells. Therefore, negative (−) charges around the scan electrode Y may be decreased compared with the prior art, while the state of the wall charges may become uniform in all cells. This is associated with the address voltage margin in the address period PA. When the bottom flat period PR 32 is lengthened during the reset period PR, the number of negative (−) charges around the scan electrode Y decreases, thereby correspondingly decreasing the address voltage margin.

A length of the bottom flat period PR32 of the falling ramp will now be described.

In the present invention, the optical waveform is measured under a condition that the falling ramp's slope is less than −10 V/μs within the reset period PR. As the result of the measurement, the intensity of the emitting visible ray may be judged to be zero when the bottom flat period PR32 is maintained for longer than 15 μs. Therefore, when the bottom flat period PR32 is maintained for longer than 15 μs and the falling ramp slope is less than −10 V/μs, the state of the wall charges may be judged to be uniform.

Figure 8:
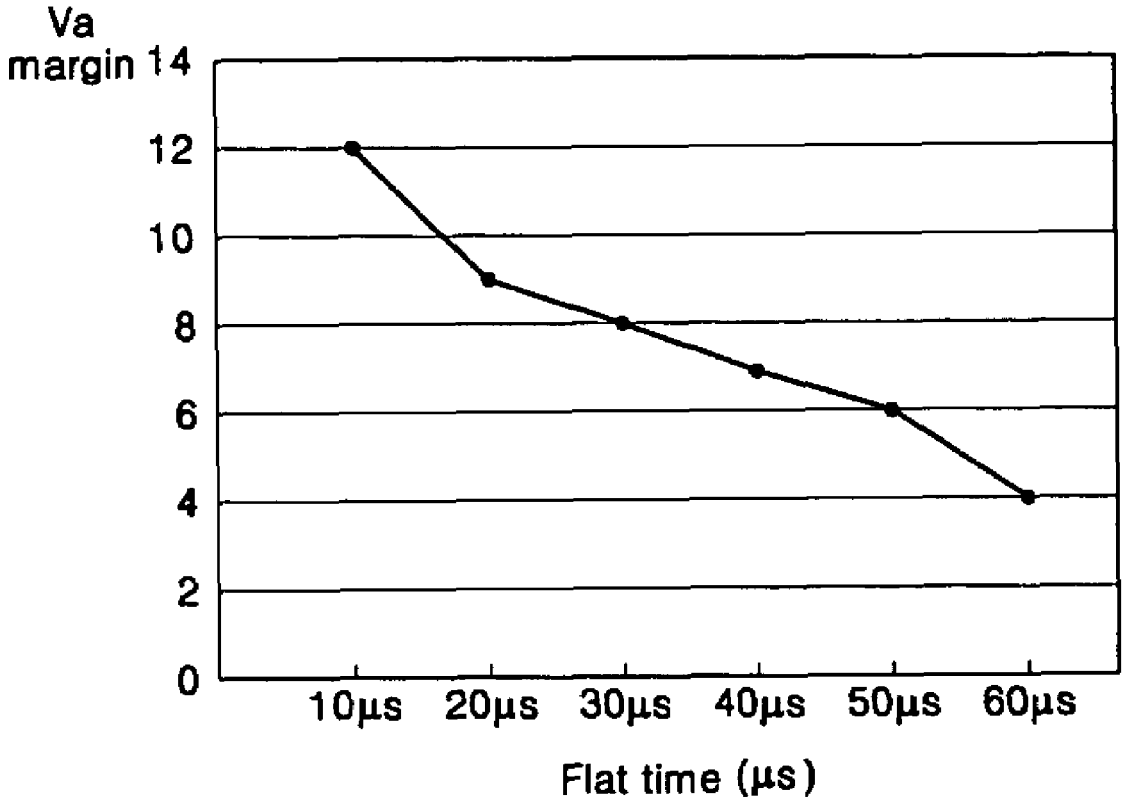
FIG. 8 shows a variation of an address voltage margin according to a length of a bottom flat period of a falling ramp.

FIG. 8 shows an exemplary test of the variation in the address voltage $V_a$ margin depending on the length of the bottom flat period PR32 of the falling ramp when the slope of the falling ramp is less than −10 V/μs.

When the bottom flat period PR32 is about 10 μs long, the address voltage $V_a$ margin is about 12 V, and it falls down to about 9 V at about 20 μs. As the bottom flat period PR32 lengthens, the $V_a$ margin decreases. When the flat period is about 60 μs, the $V_a$ margin decreases to about 4 V. As shown in FIG. 8, the $V_a$ margin is about 10 V when the flat period is about 15 μs long.

However, an excessive decrease of the $V_a$ margin may hinder the addressing operation, hence it is preferable to compensate for it.

Figure 9:
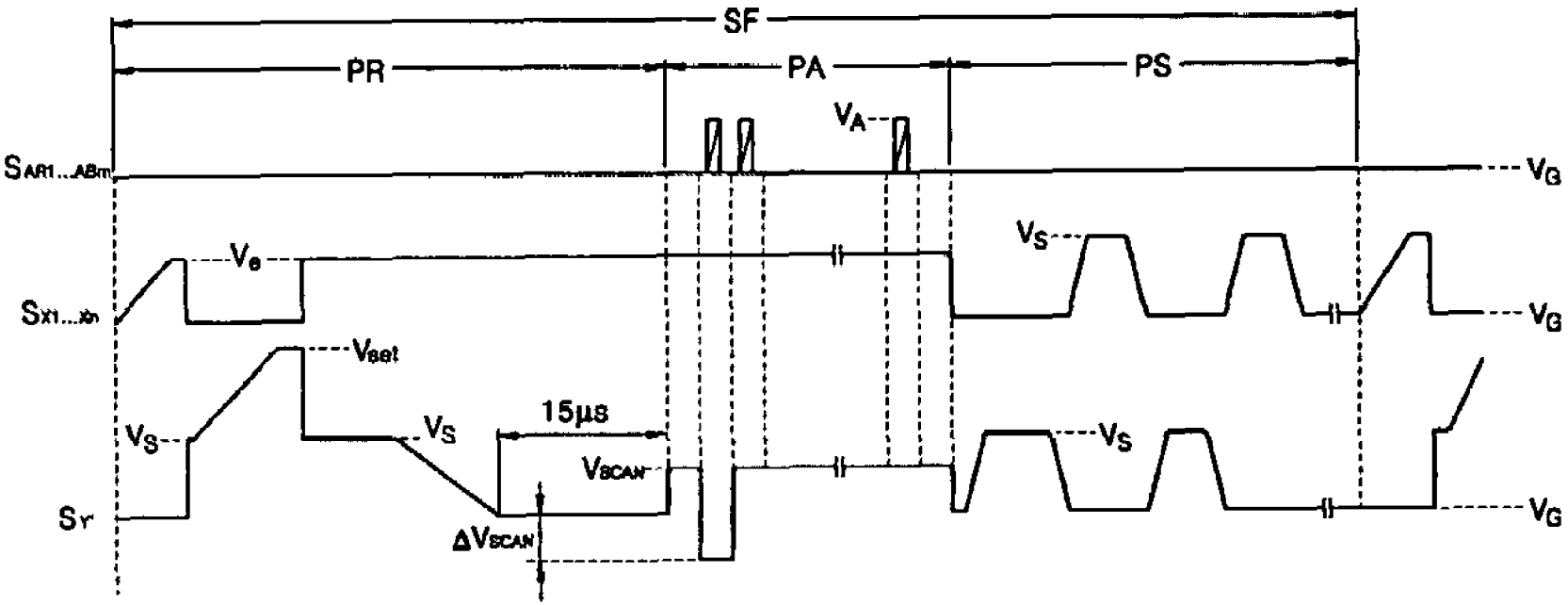
FIG. 9 shows a driving waveform of a PDP according to a second exemplary embodiment of the present invention.

FIG. 9 is a waveform illustrating a method for driving the PDP according to a second exemplary embodiment of the present invention. Referring to FIG. 9, a bottom flat period of 15 μs is provided in order to uniformly distribute the wall charges in the scan electrode $S_{y'}$ during the reset period PR. During the address period PA, a scan pulse that is less than a ground voltage $V_G$ by a predetermined voltage $\Delta V_{scan}$ may be applied to the scan electrode $S_{y'}$ to lengthen the bottom flat period. A trade-off of the $V_a$ margin may be compensated for by applying a scan pulse during the address period PA that is lower by the voltage $\Delta V_{scan}$.

The present invention may have the following effects below.

First, since the flat period of maintaining the peak voltage of the rising ramp applied to the scan electrode is sufficiently secured during the rising ramp section of the reset period, the discharge may be performed sufficiently during the rising ramp section, which may form the desired state of the wall charges.

Second, since the flat period of maintaining the bottom voltage of the falling ramp applied to the scan electrode is sufficiently secured during the falling ramp section of the reset period, the state of the wall charges may be uniformly formed in all discharge cells.

Exemplary embodiments of the present invention may be embodied as computer readable codes on a computer readable recording medium. The computer readable recording medium may be any data storage device that can store data or a program that may be read by a computer system. Examples of the computer readable recording medium include read-only memory (ROM), random-access memory (RAM), CD-ROMs, magnetic tapes, floppy disks, and optical data storage devices. The program stored in the computer readable recording medium may be expressed as a series of instruction commands that is directly or indirectly used within a computer-like device having an information processing capability in order to obtain a specific result. Therefore, "computer" means any device that includes memory, an I/O unit, an operation unit, and information processing capability. The device for driving the panel is not limited to specific fields, it may be any kind of computer.

The method for driving the PDP according to exemplary embodiments of the present invention may be created on the computer by schematic or very high speed integrated circuit hardware description language (VHDL) and it may be embodied via computer by programmable integrated circuit, for example, field programmable gate array (FPGA).

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel using a reset period, an address period, and a sustain discharge period, wherein the reset period has a rising ramp section, the method comprising:

during the rising ramp section, maintaining a flat period of a peak voltage of a rising ramp applied to a scan electrode until a variation in wall charges of the scan electrode ends in all discharge cells.

2. The method of claim 1, wherein a wall voltage of the scan electrode when the flat period ends is higher than a wall voltage of the scan electrode when the flat period starts.

3. The method of claim 1, wherein the peak voltage is higher than a discharge start voltage.

4. The method of claim 1, wherein the reset period has a falling ramp section, further comprising:

during the falling ramp section of the reset period, maintaining a flat period of a bottom voltage of a falling ramp applied to the scan electrode until wall charges of the scan electrode are uniform in all discharge cells.

5. The method of claim 1, further comprising:

encoding a computer code, for executing the method, on a computer readable recording medium.

6. A method for driving a plasma display panel using a reset period, an address period, and a sustain discharge period, wherein the reset period has a rising ramp section and a falling ramp section, the method comprising:

during the falling ramp section, maintaining a flat period of a bottom voltage of a falling ramp applied to a scan electrode until wall charges of the scan electrode are uniform in all discharge cells.

7. The method of claim 6, wherein the flat period is maintained for more than about 15 μs and a slope of the falling ramp is less than −10 V/μs.

8. The method of claim 7, wherein the falling ramp has a varying slope.

9. The method of claim 6, further comprising:

during the address period, compensating for a decrease of an address voltage margin by dropping a low level potential of a scan pulse applied to the scan electrode.

10. The method of claim 6, further comprising:

encoding a computer code, for executing the method, on a computer readable recording medium.

11. A plasma display panel (PDP), comprising:

a first electrode and a second electrode arranged in parallel on a first substrate;

a third electrode formed on a second substrate and crossing the first electrode and the second electrode; and a circuit for applying a driving signal to the first electrode, the second electrode, and the third electrode, wherein the circuit gradually rises a difference between voltages applied to the first electrode and the second electrode during a first section of a reset period from a first voltage to a second voltage, and maintains the difference between voltages at the second voltage during a second section of the reset period, wherein the second section has a period in which a wall voltage is constant in a discharge cell.

12. The PDP of claim 11, wherein the wall voltage is generated due to the voltages applied to the first electrode and the second electrode, and wherein a discharge occurs when a difference between the wall voltage and the difference between voltages applied to the first electrode and the second electrode is larger than a discharge start voltage.

13. The PDP of claim 11, wherein the first section and the second section are in a rising ramp section.

14. The PDP of claim 11, wherein the second voltage is higher than a discharge start voltage.

15. The PDP of claim 14, wherein the first voltage is lower than the discharge start voltage.

16. The PDP of claim 11, wherein the first electrode is a scan electrode and the second electrode is a sustain electrode.

* * * * *